US006938523B1

(12) United States Patent
Farrey

(10) Patent No.: US 6,938,523 B1
(45) Date of Patent: Sep. 6, 2005

(54) CLEANOUT CAP WRENCH

(76) Inventor: George T. Farrey, 7912 Elderberry Cir., North Charleston, SC (US) 29418

( * ) Notice: Subject to any disclaimer, the term of this patent is extended or adjusted under 35 U.S.C. 154(b) by 0 days.

(21) Appl. No.: 10/751,054

(22) Filed: Jan. 2, 2004

(51) Int. Cl.[7] ..... B25B 17/00
(52) U.S. Cl. ..... 81/124.4; 81/125.1; 81/176.1; D8/17
(58) Field of Search ..... 81/124.3, 124.4, 81/125, 125.1, 52, 176.1, 900; D8/16, 17, D8/19, 21, 27–29; 7/138

(56) References Cited

U.S. PATENT DOCUMENTS

| | | | | | |
|---|---|---|---|---|---|
| 64,662 | A | * | 5/1867 | Gold | 7/138 |
| 172,277 | A | * | 8/1876 | Norris | 7/142 |
| 356,925 | A | * | 2/1887 | Chamberlin | 7/144 |
| 726,782 | A | * | 4/1903 | Stone | 81/125 |
| 896,458 | A | * | 8/1908 | Morgan | 81/124.3 |
| 1,464,132 | A | * | 8/1923 | Haggardt | 81/124.3 |
| 1,596,602 | A | * | 8/1926 | Eagan et al. | 7/145 |
| 5,425,292 | A | * | 6/1995 | Mobile | 81/124.4 |
| 5,544,379 | A | * | 8/1996 | Chen | 7/138 |
| D393,578 | S | * | 4/1998 | Keddie | D8/17 |

* cited by examiner

*Primary Examiner*—David B. Thomas
(74) *Attorney, Agent, or Firm*—B. Craig Killough

(57) ABSTRACT

A wrench having at least four square voids therein which will permit manipulation of the cover or cap of a port or clean out of a sewer system, as well as permitting manipulation of other fasteners having square protrusions thereon, as is common with plumbing devices. The wrench has four generally square apertures of varying sizes, descending from a relatively large aperture to a relatively small aperture.

2 Claims, 2 Drawing Sheets

CLEANOUT CAP WRENCH

FIELD OF THE INVENTION

This invention pertains to tools generally, and is more specifically directed to a wrench that is suitable for manipulating caps or covers for plumbing lines, such as those that are found on sewer clean outs.

BACKGROUND OF INVENTION

Sewer lines and similar plumbing lines, and other conduits, have access ports or clean out ports. These ports are covered by caps or covers that may be removed for access to the port or clean out. The caps or covers are most commonly fitted by threaded means into an opening that forms the port or clean out. The caps or covers have a square protrusion that extends upwardly from the cap or cover. The square protrusion provides a means to grip the cap or cover, such as with a pipe wrench or channel locks to remove the cap or cover, and gain access to the port or clean out.

The square protrusions of the caps or covers are not of uniform size, and may vary according to the size of the cap or cover for the port or clean out. A wrench having a generally square void therein that will fit over the square protrusion, and which is relatively secure against the square protrusion, can be used to rotate the cap or cover to either remove the cap or cover, or to re-install the cap or cover.

Ports or clean outs for sewer lines are in common use in campgrounds, and in residential and commercial buildings. However, caps or covers for the sewer clean outs are of various sizes. The homeowner, camper or recreational vehicle (RV) owner must be able to remove the caps or covers that are present at the sewer system or dumping station systems. The camper or RV owner needs multiple wrenches, which is not desirable due to the limited space available within the camper or RV, or run the risk that the appropriate size of wrench is not available. Alternatively, the owner must travel with a heavy pipe wrench, which is undesirable for people with small hands. It is very undesirable to be unable to access the sewer system at home, or at a campground or RV park.

SUMMARY OF THE INVENTION

The present invention is a wrench having at least four square voids therein which will permit manipulation of the cover or cap of a port or clean out of a sewer system, as well as permitting manipulation of other fasteners having square protrusions thereon, as is common with plumbing devices. The wrench has four generally square apertures of varying sizes, descending from a relatively large aperture to a relatively small aperture.

DESCRIPTION OF THE PREFERRED EMBODIMENT

Figure 2:
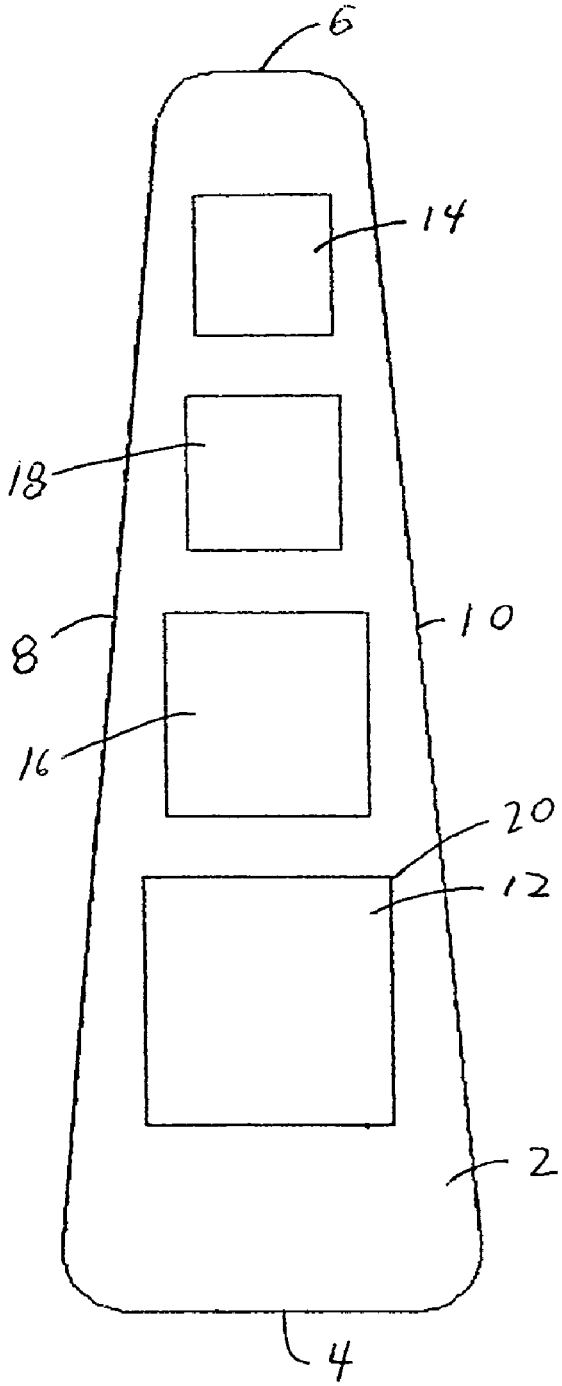
FIG. 2 is a top plan view of a wrench according to the present invention.

Referring now to the drawing figures, FIG. 2 shows a top plan view of the preferred embodiment of the present invention. The wrench is a generally flat plane 2, which is substantially trapezoidal in shape, although each corner of the wrench is rounded to eliminate sharp corners. The first end 4 and an opposite end 6 of the wrench are generally parallel to each other, while the opposite sides 8, 10 taper in the same direction, and preferably linearly, about a centerline of the longitudinal axis of the generally trapezoidal shape. The resulting generally flat plane has a relatively wide end which tapers to a relatively narrow end. At least four generally square apertures are formed in the flat plane. The largest square aperture 12 is formed near the largest end of the generally flat plane, and the smallest square aperture 14 is formed near the opposite, and smaller in width, end of the plane. Of the two remaining generally square apertures, the larger square aperture 16 is adjacent to the largest square aperture, and the smaller square aperture 18 is adjacent to the smallest square aperture. Each aperture is substantially square, so as to engage the substantially square protrusions from caps or covers of sewer clean outs and the like, so that the square protrusion can be accepted within the appropriate square aperture. The square apertures will therefore have sides of substantially the same length, although features such as rounded corners for the apertures may be employed, as long as the corners are rounded in a manner which allows the square protrusion to be accepted within the apertures.

Figure 1:
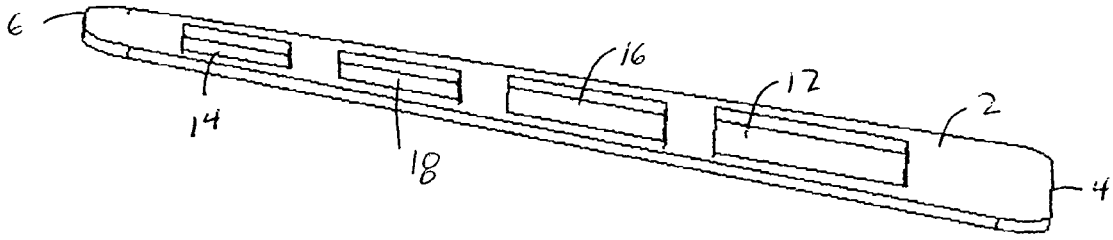
FIG. 1 is a perspective view of the wrench of the present invention.

The wrench is preferred to be formed in a generally flat plane along its entire length, as is shown in FIG. 1, for ease of manufacture and for ease of storage. The device may be manufactured by stamping the wrench from sheets of metal, such as a sheet of aluminum. The resulting flat plane may be easily stored in a toolbox, camper, or RV, when space is at a premium.

The apertures are formed to allow sufficient material between the point of the aperture 20 that is closest to the edge of the wrench. While this minimum dimension will vary according to the material that is used to form the wrench, and the strength of the material, if the wrench is formed by stamping the wrench from ⅛ thick aluminum, the minimum distance between the aperture and the edge of the wrench should be about ⅜ inch, and is preferred to be about 7/16 inch or more.

Likewise, while the length and width of the wrench will depend upon the sizes of the apertures to be incorporated. If four generally square apertures having sides of 1⅛ inches, 1¼ inches, 1⅝ inches, and 2 inches in length are formed, the wrench could have a length of nine (9) to twelve (12) inches, and a width of about 3½ inches tapering down to about 1¾ inches. The dimension between the first end of the wrench to the closest side of the largest aperture may be from about 1⅜ inch to 1¾ inches, and the length from the opposite end of the wrench to the closest side of the smallest aperture may be from about ⅞ inch to about 1¼ inch. The distance between apertures are preferred to be ½ inch when the wrench is formed from ⅛ inch thick aluminum.

The wrench may be formed of any material of sufficient strength, but will typically be stamped from metal, plastic, PLEXIGLAS, or LEXAN. An appropriate metal from which to stamp the wrench, for reasons of weight, is aluminum. If aluminum is used, the wrench should have a thickness from about ⅛ inch to 3/16 inch to provide sufficient strength.

In use, an aperture of appropriate size is selected from the four apertures, and engaged over the square protrusion of the cover, preferably until the wrench is substantially flush against the cover, with the square protrusion extending through the appropriate aperture. The wrench is then rotated appropriately to either remove, or re-install, the cover.

What is claimed is:

1. A wrench comprising a generally flat plane, wherein said generally flat plane is formed of a material that comprises metal, and said generally flat plane has exactly four square apertures formed therein, wherein each of said four square apertures is of a different size from each remaining aperture and wherein said generally flat plane is characterized by an entirely flat top surface and an entirely flat bottom surface, and wherein said four square apertures extend through said entirely flat top surface and through said entirely flat bottom surface, wherein one of said four square apertures has a side with a length of 1⅛ inches, wherein another of said four square apertures has a side with a length of 1¼ inches, wherein another of said four square apertures has a side with a length of 1⅝ inches, and wherein another of said four square apertures has a side with a length of 2 inches.

2. A wrench comprising a generally trapezoidal plane, said generally trapezoidal plane has exactly four square apertures formed therein, wherein each of said four square apertures has at least two sides that are generally parallel to each of two generally parallel sides of said generally trapezoidal plane, wherein one of said four square apertures has a side with a length of 1⅛ inches, wherein one of said four square apertures has a side with a length of 1¼ inches, wherein one of said four square apertures has a side with a length of 1⅝ inches, and wherein one of four square apertures has a side with a length 2 inches.

* * * * *